US008651037B1

(12) United States Patent
Tseng

(10) Patent No.: US 8,651,037 B1
(45) Date of Patent: Feb. 18, 2014

(54) DRIVE STRUCTURE FOR DRIVING AN UPPER THREAD WIPER OF A SEWING MACHINE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 0 days.

(21) Appl. No.: 13/651,361

(22) Filed: Oct. 12, 2012

(51) Int. Cl.
*D05B 29/12* (2006.01)

(52) U.S. Cl.
USPC ..... 112/286

(58) Field of Classification Search
USPC ..... 112/68, 80.5, 80.7, 285, 286, 253, 302, 112/235, 240, 287, 291–298
See application file for complete search history.

(56) References Cited

U.S. PATENT DOCUMENTS

| | | | | |
|---|---|---|---|---|
| 2,251,676 | A * | 8/1941 | Gunther | 112/104 |
| 3,847,102 | A * | 11/1974 | Rogner | 112/286 |
| 4,245,577 | A * | 1/1981 | Zocher | 112/475.17 |
| 4,352,333 | A * | 10/1982 | Yamazawa | 112/291 |
| 4,550,672 | A * | 11/1985 | Kastrup | 112/293 |
| 4,714,037 | A * | 12/1987 | Johnson et al. | 112/184 |
| 5,417,173 | A * | 5/1995 | Mitsuji | 112/475.01 |
| 6,941,881 | B2 * | 9/2005 | Noguchi et al. | 112/286 |
| 7,082,886 | B2 * | 8/2006 | Noguchi et al. | 112/286 |
| 7,085,617 | B2 * | 8/2006 | Kaiya et al. | 112/475.19 |
| 7,134,398 | B2 * | 11/2006 | Fujihara | 112/286 |

FOREIGN PATENT DOCUMENTS

| | | |
|---|---|---|
| TW | 352397 A | 2/1999 |
| TW | 407653 U | 10/2000 |

* cited by examiner

*Primary Examiner* — Danny Worrell
(74) *Attorney, Agent, or Firm* — Banger Shia

(57) ABSTRACT

A drive structure for driving an upper thread wiper of a sewing machine is provided, wherein the upper thread wiper and a drive device for driving the upper thread wiper are disposed on the cantilever and located close to the end of the needle shaft. In addition to that the drive device simplifies relative motion transmission structure, the cooperative arrangement between the upper thread wiper and the drive device further improves the power transmission efficiency and stability. The upper thread wiper can be quickly and easily assembled onto or removed from the wiper arm through a quick release device. Moreover, the drive structure is further provided with a clutch device which is capable of effecting or interrupting power transmission as desired.

20 Claims, 11 Drawing Sheets

DRIVE STRUCTURE FOR DRIVING AN UPPER THREAD WIPER OF A SEWING MACHINE

BACKGROUND OF THE INVENTION

1. Field of the Invention

The present invention relates to a sewing machine, and more particularly to a drive structure for driving an upper thread wiper of a sewing machine.

2. Description of the Prior Art

Conventionally, the power source of a drive structure for an upper thread wiper of a sewing machine is transmitted by a mainshaft which is mounted on a base of the sewing machine, which a continuous power transmitting system. The structure of this kind of power transmitting system is complicated and difficult to adjust, and consequently has a high manufacturing and maintenance cost. Hence, the applicant of this application has invented "a coaxially clockwise driven needle shaft and upper thread wiper of a sewing machine", wherein the structures of the power of the upper thread wiper and the needle shaft have been simplified. However, the applicant of the present invention is not satisfied with the improvement made in the "a coaxially clockwise driven needle shaft and upper thread wiper of a sewing machine" and has made further improvement to the drive structure for the upper thread wiper.

SUMMARY OF THE INVENTION

The primary object of the present invention is to provide a drive structure for an upper thread wiper of a sewing machine, wherein the upper thread wiper and a drive device for driving the upper thread wiper are disposed on the cantilever and located close to the end of the needle shaft. In addition to that the drive device simplifies relative motion transmission structure, the cooperative arrangement between the upper thread wiper and the drive device further improves the power transmission efficiency and stability.

To achieve the above object, a drive structure for driving an upper thread wiper of a sewing machine, the sewing machine comprises a base and a cantilever extending from the base, on the cantilever is disposed a needle-shaft driving shaft for driving a needle shaft mounted on the cantilever to repeatedly move up and down. The upper thread wiper of the sewing machine is disposed on a wiper arm. A drive device is disposed between the needle-shaft driving shaft and the wiper arm. The drive device is provided with a drive member and a motion-transmission rod for converting rotation of the needle-shaft driving shaft into swing motion of the wiper arm. One end of the drive member is drivingly connected to and driven by the needle-shaft driving shaft. Another end of the driving member is pivoted to one end of the motion-transmission rod via a pin. Another end of the motion-transmission rod is formed with a cylindrical inserting portion. One end of the wiper arm is formed with a second pivot portion for insertion of a fixing pivot which is fixed to the cantilever, and the upper thread wiper is fixed at another end of the wiper arm, and the wiper arm is formed with a pivot hole for insertion of the inserting portion.

Another object of the present invention is to provide a drive structure for an upper thread wiper of a sewing machine, wherein the upper thread wiper can be quickly and easily assembled onto or removed from the wiper arm.

To achieve the above object, a quick release device is disposed between the upper thread wiper and the wiper arm. A free end of the wiper arm is an engaging end which is formed with a first stop portion. The upper thread wiper has a connecting end. The quick release device includes a positioning sleeve and a key, the positioning sleeve is formed with an inserting portion for accommodation of the connecting end and also for insertion of the engaging end of the wiper arm, the positioning sleeve includes an elastic portion which is provided with a spiral spring to push against the key, the positioning sleeve is formed with a second stop portion, the elastic portion is provided with an engaging portion to be elastically engaged with the first stop portion of the wiper arm, the key is formed with a first chamber for accommodation of the spring and the elastic portion so as to provide an elastic force for separating the key and the positioning sleeve from each other, the key is formed with an extending portion which extends toward the second stop portion, and at a distal end of the extending portion is formed a stop flange which is stopped and pressed against the second stop portion to make the engaging portion elastically engaged in the first stop portion, or pressing the key can make the engaging portion of the elastic portion disengage from the first stop portion, so that the upper thread wiper is removed from wiper arm.

Yet, another object of the present invention is to provide a drive structure for an upper thread wiper of a sewing machine, which is capable of effecting or interrupting power transmission.

To achieve the above object, the drive device is further provided with a clutch device for driving the needle shaft, the oscillating member is provided with a clutch hole for the clutch rod to engage in and disengage from the clutch hole, the clutch rod is pivotally inserted in the driven portion of the drive member, and one end of the clutch rod that extends out of the driven portion is driven by the clutch device, the clutch device includes a clutch member, a switch member, a press member, an flexible member, and a support pivot, the clutch member is slidably mounted on the needle-shaft driving shaft and fixed on the clutch rod, a push member is sleeved on the needle-shaft driving shaft to provide an elastic force to push the clutch member toward the drive member.

The switch member is formed with a third pivot portion for insertion of a pivot which is fixed on the cantilever, the switch member is formed with a push portion which extends toward the clutch member, so that the clutch member is pushed by the push member to rest against the push portion, when the switch member moves, the push portion will push the clutch member to make the clutch rod engage in or disengage from the oscillating member.

The support pivot is inserted through the press member and the flexible member and has one end fixed to the switch member and another screwed with a bolt, so that the flexible member is pushed by the bolt to provide a force for pushing the press member toward the cantilever, the press member is formed with a press portion for a user to press.

DETAILED DESCRIPTION OF THE PREFERRED EMBODIMENTS

Figure 1:
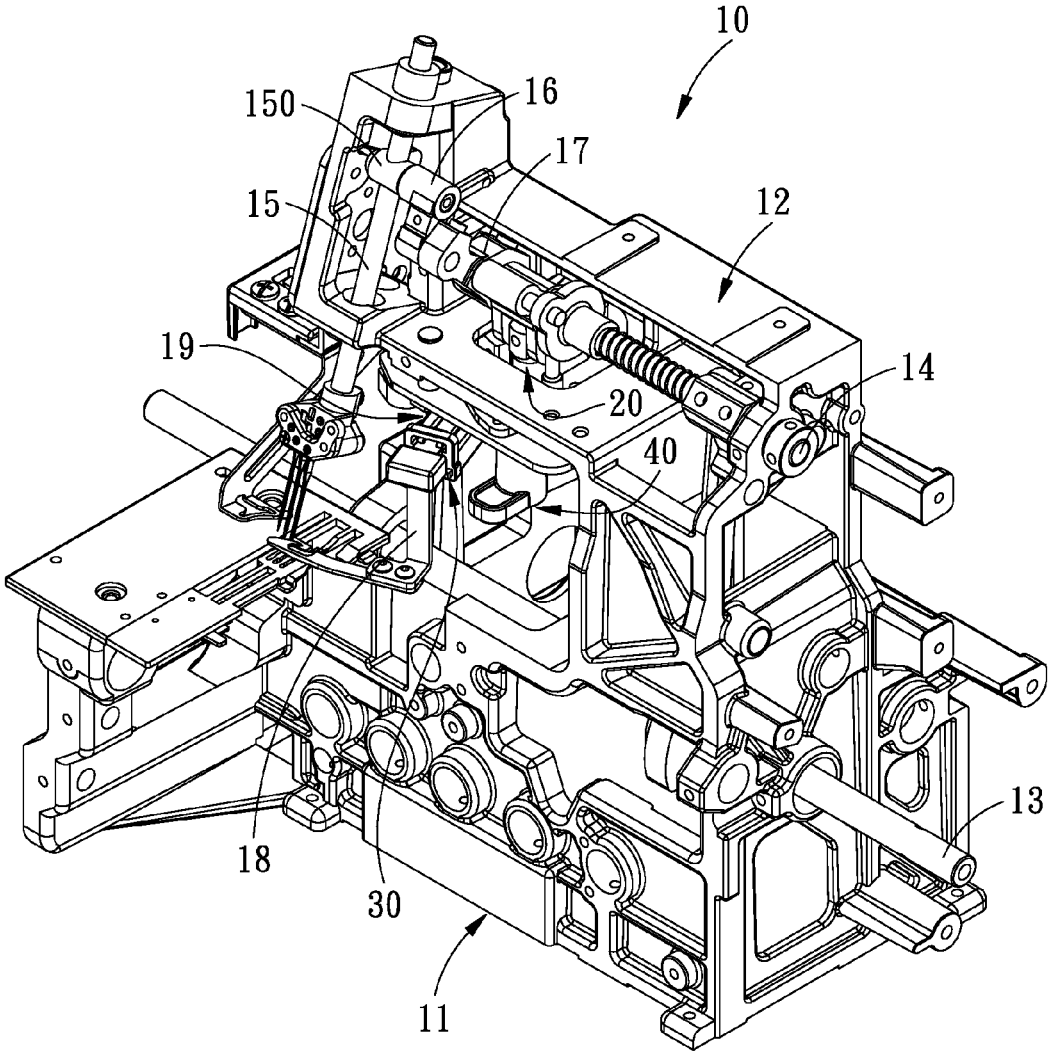
FIG. 1 is a perspective view of a drive structure for driving an upper thread wiper of a sewing machine in accordance with a first preferred embodiment of the present invention.

The present invention will be clearer from the following description when viewed together with the accompanying drawings, which show, for purpose of illustrations only, the preferred embodiment in accordance with the present invention.

Referring to FIGS. 1-4, a drive structure for driving an upper thread wiper 18 of a sewing machine 10 in accordance with a first preferred embodiment of the present invention is shown, wherein the sewing machine 10 essentially comprises a base 11 and an L-shaped cantilever 12 extending upward from the base 11. In the base 11 is disposed a mainshaft 13 to be rotated by a motor (not shown). On the cantilever 12 is disposed a needle-shaft driving shaft 14 which is in parallel with and rotated by the mainshaft 13. The needle-shaft driving shaft 14 has one end rotated by the mainshaft 13 and has another end provided with an oscillating member 17 which is connected by a connecting rod 16 to a connecting block 150 disposed on a needle shaft 15, so that the needle shaft 15 is driven by the needle-shaft driving shaft 14 to repeatedly move up and down. Since the driving structure for driving the needle shaft 15 to move is a conventional structure, further descriptions are omitted.

The upper thread wiper 18 of the sewing machine 10 is driven by a wiper arm 19, and this is also a conventional structure. The present invention is characterized in that a drive device 20 is disposed between the oscillating member 17 for driving the needle shaft 15 and the wiper arm 19, so as to make the wiper arm 19 swing horizontally, unlike the conventional up-and-down movement of the needle shaft 15 driven by the needle-shaft driving shaft 14.

Figure 3:
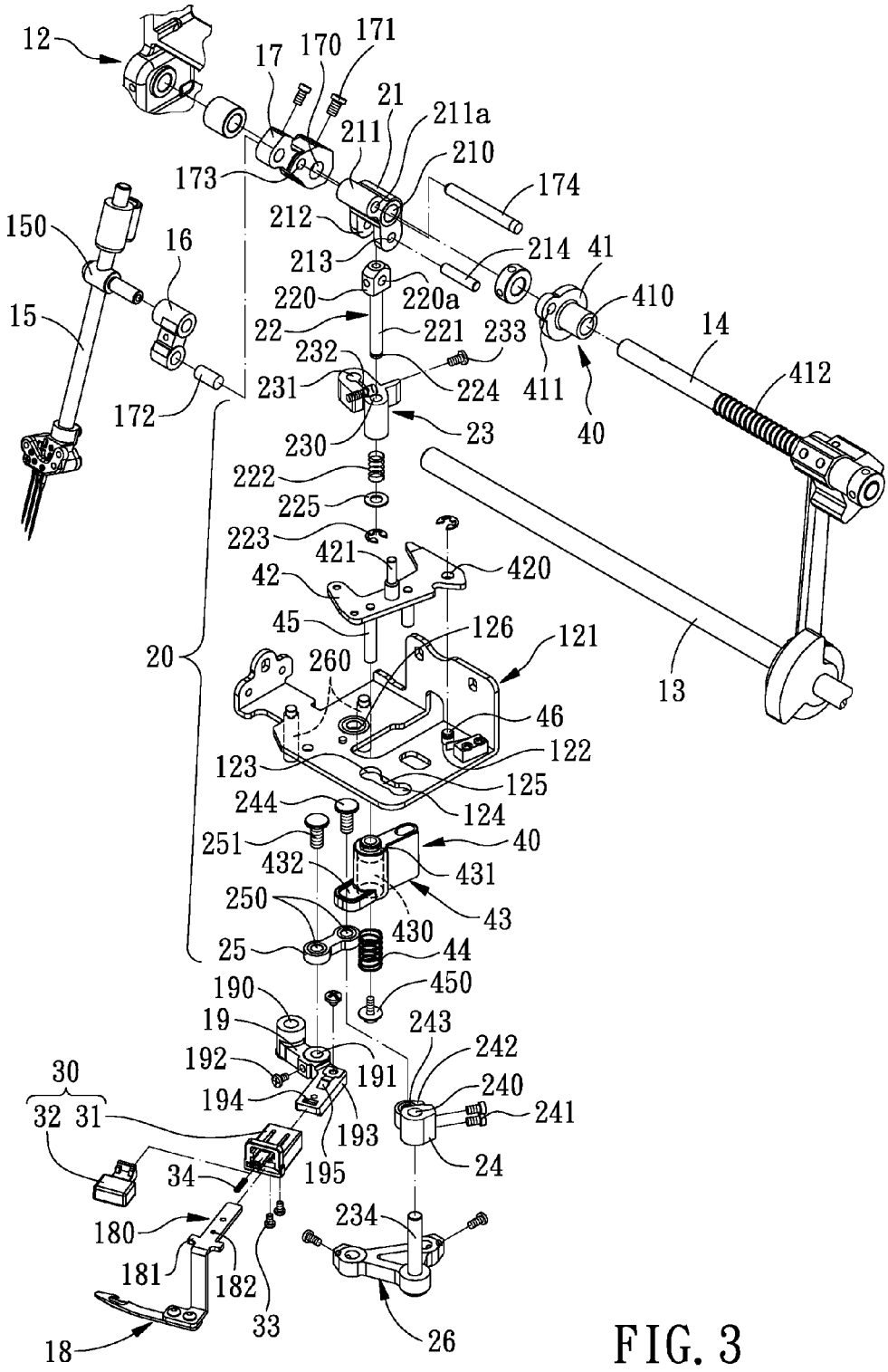
FIG. 3 is an exploded view of the drive device, the quick release device and the clutch device in accordance with the present invention.
Figure 4:
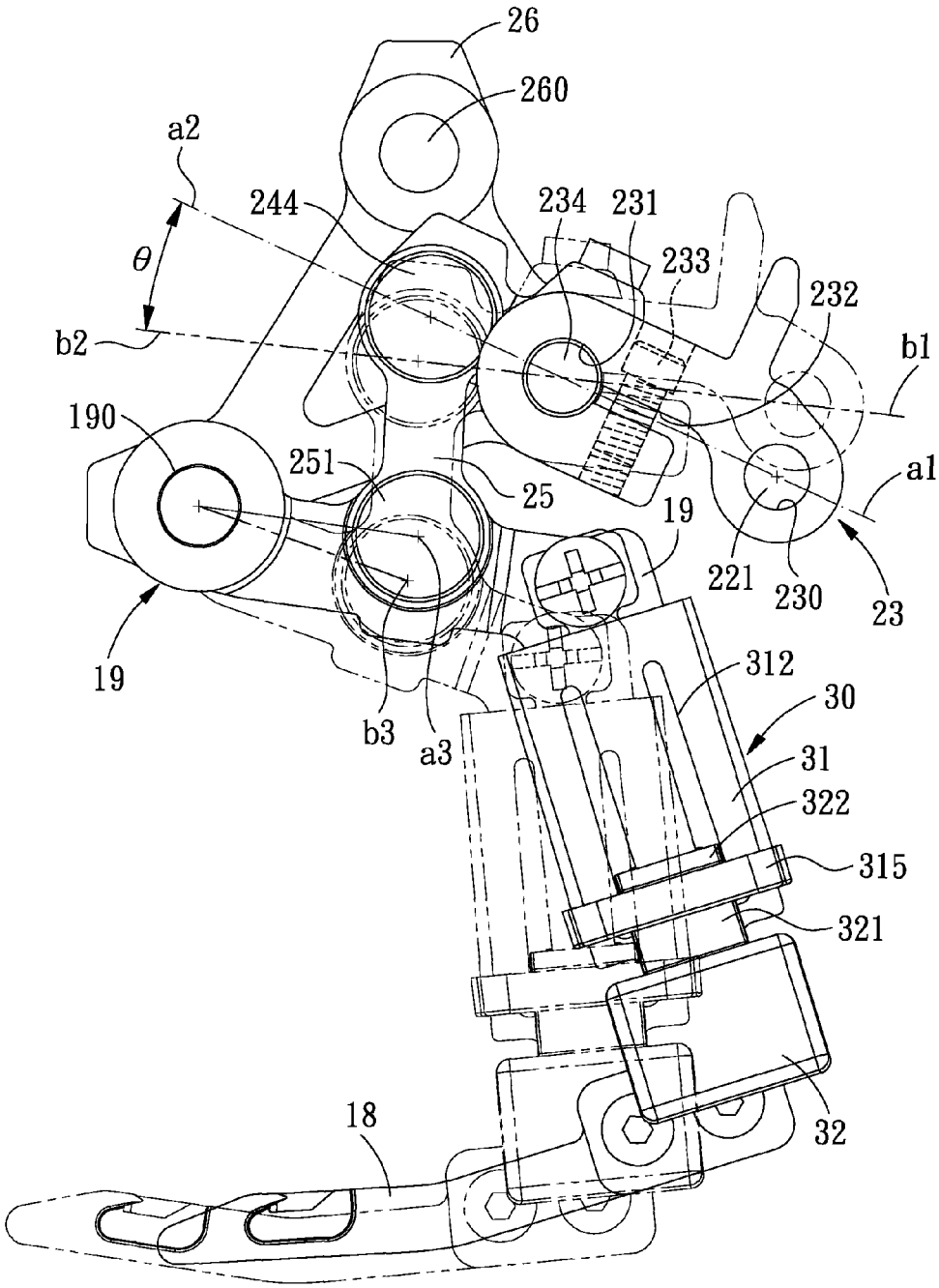
FIG. 4 is an operational view of the drive device of a drive structure for driving an upper thread wiper of a sewing machine in accordance with the present invention.

Referring to FIGS. 3 and 4, the oscillating member 17 is such a structure that the outer diameter at both ends of the oscillating member 17 is larger than the outer diameter in the middle portion of the oscillating member 17. One end of the oscillating member 17 is formed an inserting hole 170, and the needle-shaft driving shaft 14 is inserted and fixed in the inserting hole 170 of the oscillating member 17 by bolts 171. Another end of the oscillating member 17 is connected to one end of the connecting rod 16 by a connecting shaft 172, and another end of the connecting rod 16 is pivoted to the connecting block 150 and serves to drive the needle shaft 15 to move. In the middle portion of the oscillating member 17 is defined a clutch hole 173 for insertion of one end of a clutch rod 174, and another end of the clutch rod 174 is connected to the drive device 20.

The drive device 20 is provided with a drive member 21, a motion-transmission rod 22, a rod-inserting member 23, an oscillating element 24 and a linking rod 25 which are interconnected to one another and serve to transmit power to the wiper arm 19. The drive member 21 is an elongated block whose middle portion is slightly bent, in the middle portion of the drive member 21 is formed a through hole 210 for insertion of the needle-shaft driving shaft 14, one end of the drive member 21 is formed with a driven portion 211 in the form of a hole for insertion of the clutch rod 174, and another end of the drive member 21 is formed with two ears 212. The motion-transmission rod 22 has one end inserted between the two ears 212, each of the ears 212 is formed with a pin hole 213, and a pin 214 is inserted through the pin holes 213 of the ears 212 and the end of the motion-transmission rod 22, so that the motion-transmission rod 22 is pivoted to the drive member 21 by the pin 214.

The end of the motion-transmission rod 22 inserted between the ears 212 is formed with a first pivot portion 220 which includes two opposed flat surfaces and two opposed arc-shaped surfaces (not numbered). The pin 214 is inserted through the two opposed flat surfaces, and there is a clearance between the first pivot portion 220 and the two ears 212, so that the first pivot portion 220 can move along the pin 214 between the two ears 212 so as to absorb the displacement of the motion-transmission rod 22 caused when the motion-transmission rod 22 moves up and down while being driven to swing back and forth by the drive member 21, and caused by the horizontal swing of the rod-inserting member 23. At a bottom of the first pivot portion 220 is a cylindrical first inserting portion 221 whose outer diameter is smaller than that of the first pivot portion 220.

The rod-inserting member 23 is L-shaped and includes a perpendicular inserting rod 230 at one end thereof. The first inserting portion 221 of the motion-transmission rod 20 is inserted through the inserting rod 230, and on an end of the first inserting portion 221 that extends out of the inserting rod 230 is sleeved an elastic member 222. The end of the first inserting portion 221 that extends out of the inserting rod 230 is formed with an annular groove (not numbered) in which a washer (not numbered) and a C-shaped retainer 223 are engaged to prevent the elastic member 222 from disengaging from the first inserting portion 221. The elastic member 222 has one end pushed against the end of the inserting rod 230 of the rod-inserting member 23, so as to provide an elastic force between the rod-inserting member 23 and the motion-transmission rod 22, making the rod-inserting member 23 and the motion-transmission rod 22 slide more stably with respect to each other.

Another end of the rod-inserting member 23 is U-shaped to form a shaft-retaining portion 231 in the form of a hole and a slit 232 in communication with the shaft-retaining portion 231. A rotary shaft 234 has one end inserted in the shaft-retaining portion 231, and a bolt 233 is screwed through the slit 232 to retain the rotary shaft 234 within shaft-retaining portion 231 in a clamping manner, so that the rotary shaft 234 can be driven to rotate by the rod-inserting member 23.

One end of the oscillating element 24 is formed with a rotary-shaft hole 240 for insertion of another end of the rotary shaft 234, and two bolts 241 are laterally screwed in the rotary-shaft hole 240 to fix the rotary shaft 234, so that the oscillating element 24 is drivingly connected to the rotary shaft 234. At another end of the oscillating element 24 is formed a horizontal oscillating portion 242 which is formed with a central hole 243 for insertion of a first bolt 244, so as to pivotally connect the oscillating element 24 to the linking rod 25.

The linking rod 25 is an elongated block with two circular ends. Each end of the linking rod 25 is formed with a bolt hole 250 for insertion of the first bolt 244 and a second bolt 251, respectively, and the second bolt 251 has one end inserted in the wiper arm 19 so as to drive the wiper arm 19.

The wiper arm 19 is an L-shaped structure, and one end of the wiper arm 19 is formed with a cylindrical hollow second pivot portion 190 which is to be pivotally connected a corresponding part of the cantilever 12. For example, in the second pivot portion 190 is inserted a fixing pivot 260 which has one end fixed to a first corner of a triangle mounting frame 26, the rotary shaft 234 is pivoted to a second corner of the mounting frame 26, and another fixing pivot 260 is fixed to a third corner of the mounting frame 26, so as to fix the mounting frame 26 to a bottom of the cantilever 12.

At a middle portion of the wiper arm 19 is defined a pivot hole 191 for insertion the one end of the second bolt 251, and a bolt 192 is laterally screwed in the pivot hole 191 to fix the second bolt 251, so that the wiper arm 19 is pivotally and drivingly connected to the linking rod 25.

Figure 5:
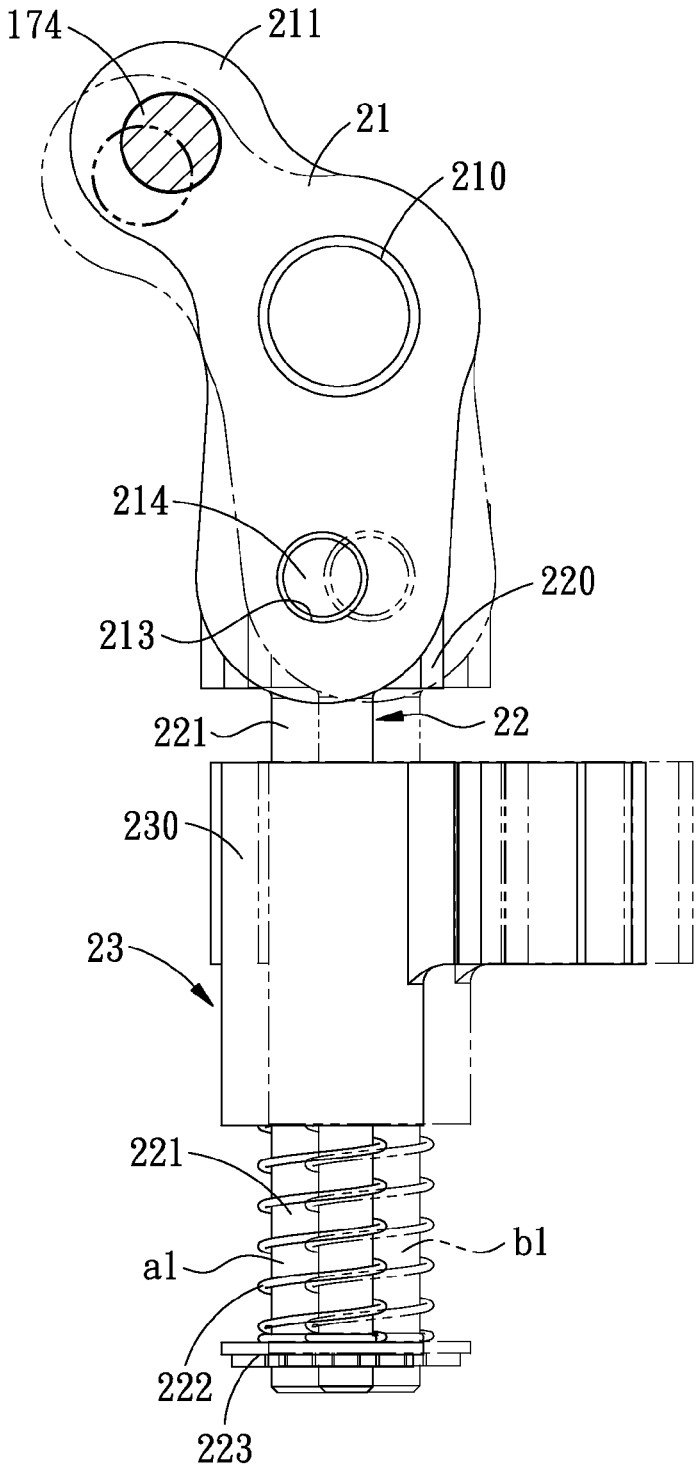
FIG. 5 is a side view showing that the drive member of the drive device in accordance with the present invention cooperates with the rod-inserting member.

When the needle-shaft driving shaft 14 rotates back and forth, the drive member 21, the drive member 21 will swing synchronously and coaxially with the oscillating member 17 since it is drivingly connected to the oscillating member 17 by the clutch rod 174. The motion-transmission rod 22, as shown in FIGS. 4 and 5, will move up and down repeatedly between two positions a1 and b1 to make the inserting rod 230 of the rod-inserting member 23 and the first inserting portion 221 slide with respect to each other. Meanwhile, the inserting rod 230 moves horizontally between the positions a1 and b1, so that the rotary shaft 234 at another end of the rod-inserting member 23 will have a rotating angle θ, and the oscillating element 24 will rotate by the rotating angle θ. Consequently, the first bolt 244 of the linking rod 25 is driven to move repeatedly between two positions a2 and b2, and the second bolt 251 of the linking rod 25 is driven to move repeatedly between two positions a3 and b3, so that the wiper arm 19 will rotate around the second pivot portion 190 to drive the upper thread wiper 18 to rotate.

Figure 6:
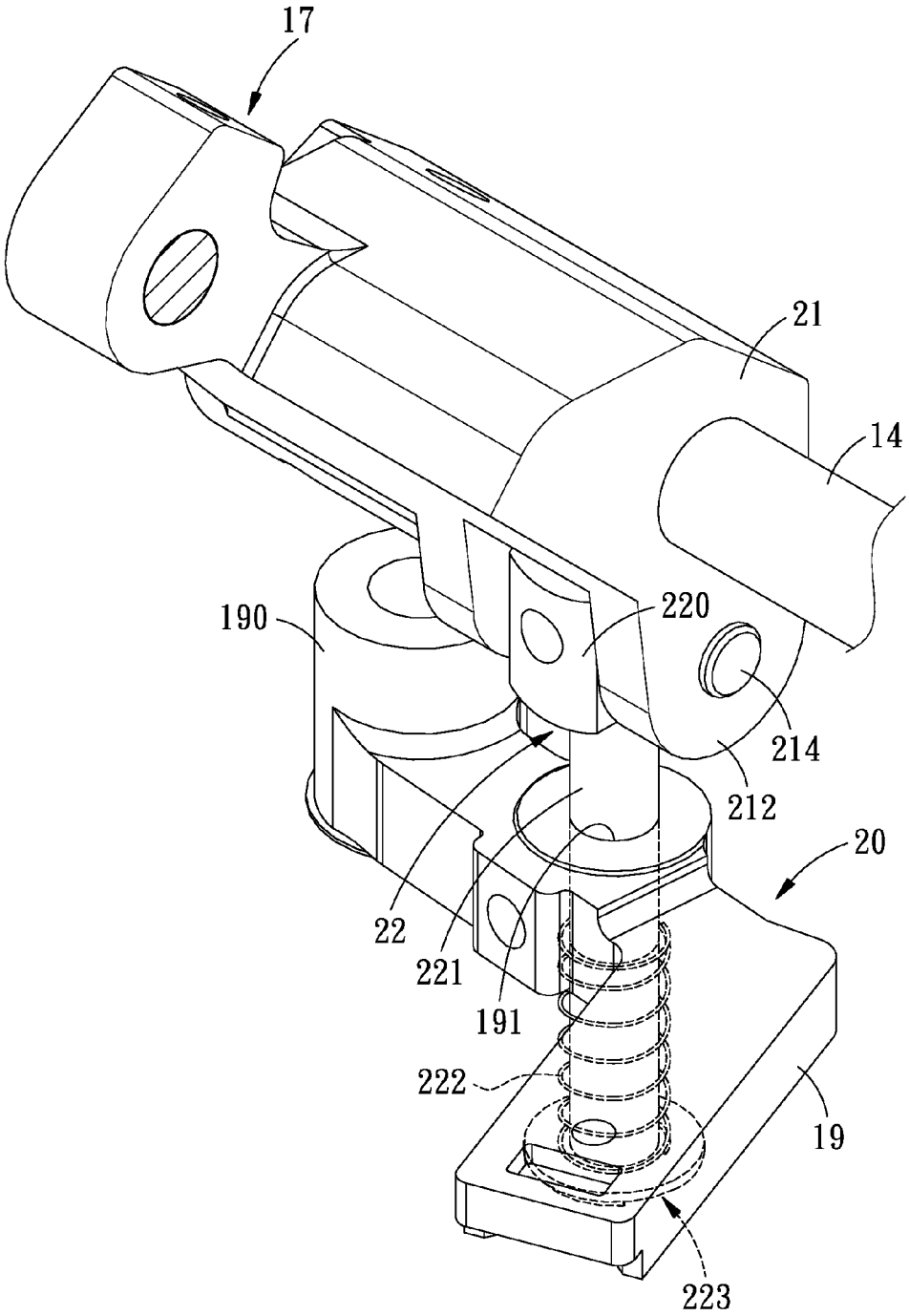
FIG. 6 is a perspective view of a drive structure for driving an upper thread wiper of a sewing machine in accordance with a second preferred embodiment of the present invention.

A drive device 20 in accordance with a second embodiment of the present invention can also be simplified as shown in FIG. 6, wherein the drive member 21 and the oscillating member 17 on the needle-shaft driving shaft 14 can be integral with each other, so that the power can be transmitted directly to the drive member 21 and the oscillating member 17 from the needle-shaft driving shaft 14. The drive member 21 is pivoted to a motion-transmission rod 22 which has an first inserting portion 221 inserted in the pivot hole 191 of the wiper arm 19, and on an end of the first inserting portion 221 that extends out of the pivot hole 191 are sleeved an elastic member 222 and a C-shaped retainer 223. The second pivot portion 190 at one end of the wiper arm 19 is pivoted to a corresponding part of a sewing machine, and another end of the wiper arm 19 is assembled to the upper thread wiper 18. The drive device 20 of this embodiment is also capable of transmitting power as the drive device 20 of the first embodiment. The drive member 21 has two ears 212 at two ends thereof, a pin 214 is inserted through the two ears 212. The end of the motion-transmission rod 22 inserted between the ears 212 is a formed with a first pivot portion 220 for insertion of the pin 214, there is a clearance between the first pivot portion 220 and the two ears 212, and another end of the oscillating member 17 is drivingly connected to the needle shaft 15 by a connecting shaft 172.

Figure 7:
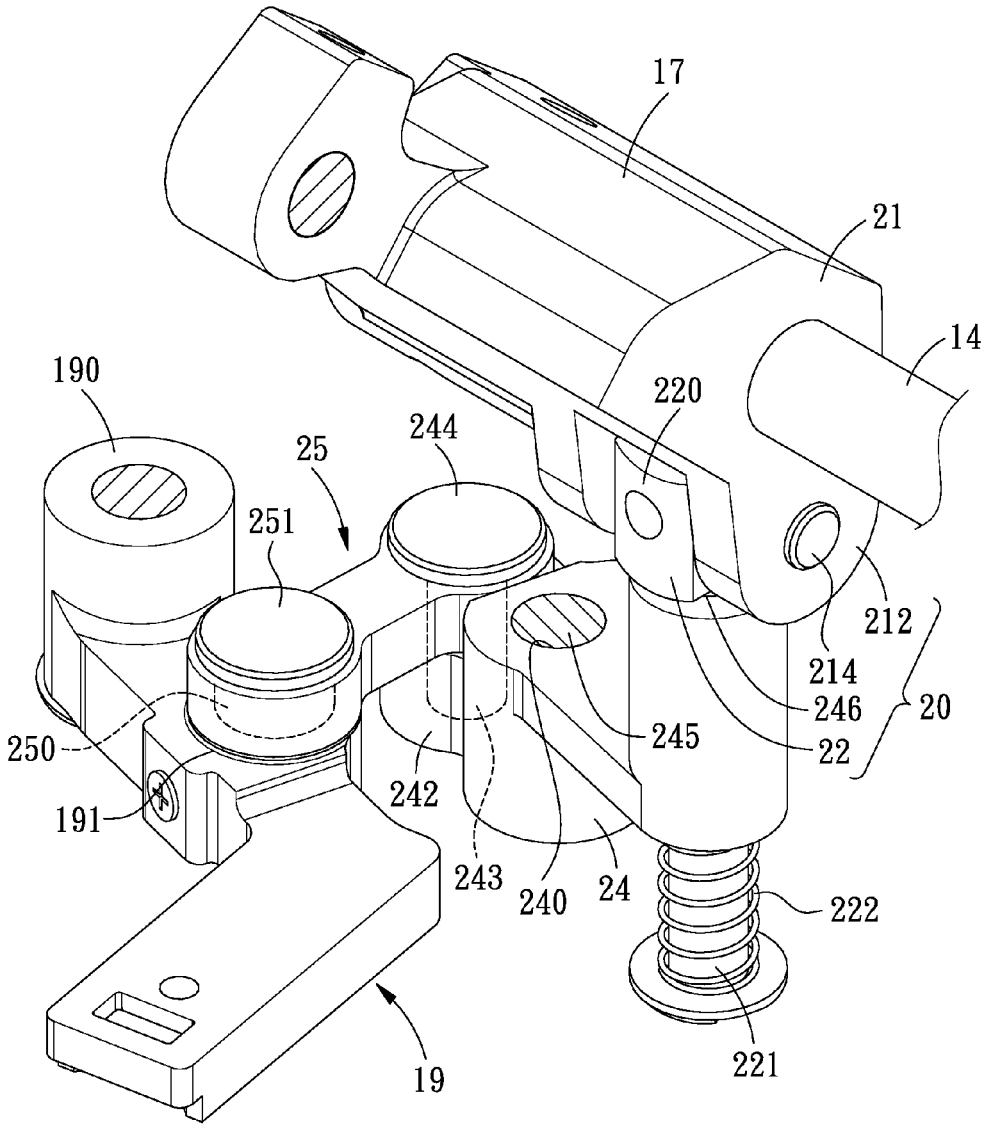
FIG. 7 is a perspective view of a drive structure for driving an upper thread wiper of a sewing machine in accordance with a third preferred embodiment of the present invention.
Figure 8:
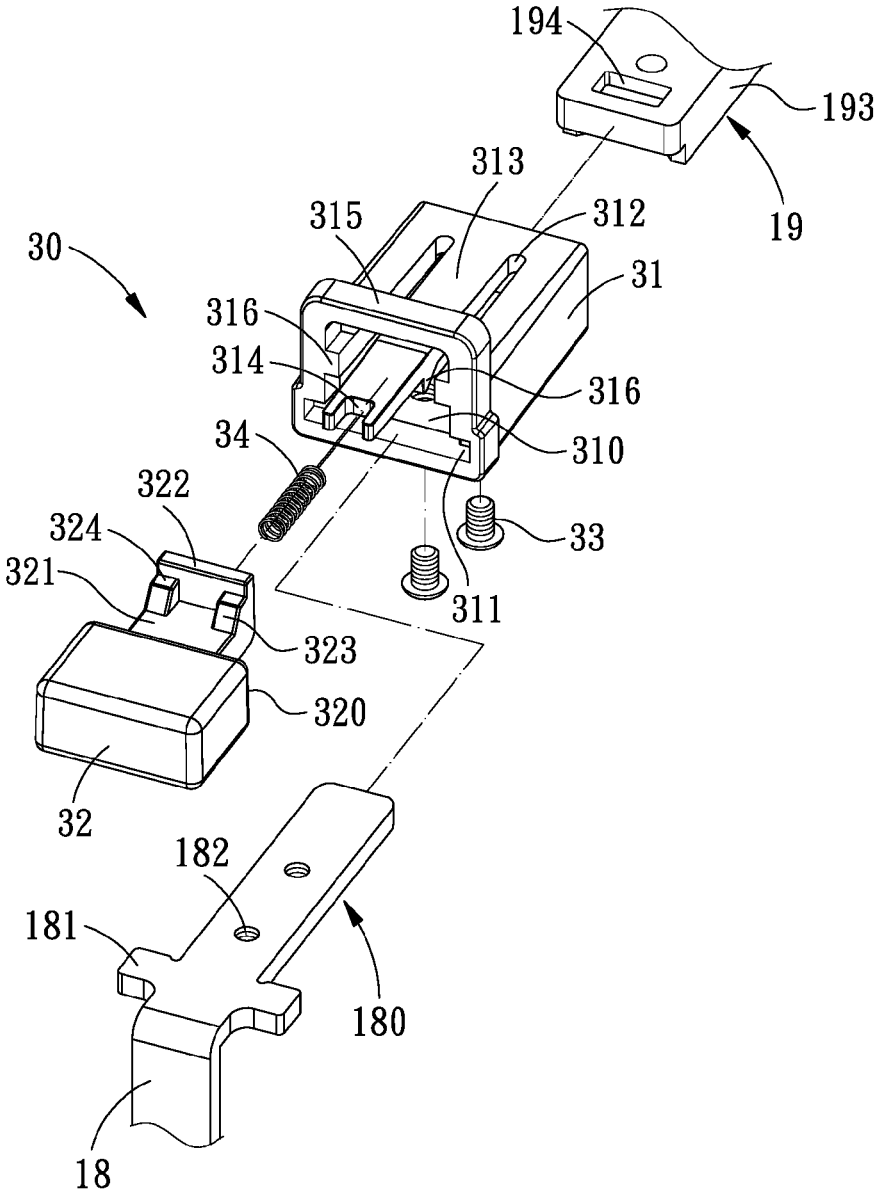
FIG. 8 is an exploded view of a drive device of the present invention.

Further, a drive device 20 in accordance with a third embodiment of the present invention can also be simplified as shown in FIG. 7, wherein the drive member 21 and the oscillating member 17 on the needle-shaft driving shaft 14 can be integral with each other, so that the power can be transmitted directly to the drive member 21 and the oscillating member 17 from the needle-shaft driving shaft 14. The drive member 21 is pivoted to a motion-transmission rod 22 which has a first inserting portion 221 inserted in one end of an oscillating element 24. The oscillating element 24 has a middle portion pivoted in the cantilever 12 and another end pivoted to one end of a linking rod 25, and another end of the linking rod 25 is pivoted in a pivot hole 191 of the wiper arm 19 to drive the wiper arm 19 to swing.

In the middle portion of the oscillating element 24 is defined a rotary-shaft hole 240 for insertion of a connecting pivot 245 fixed on the cantilever 12, and both ends of the oscillating element 24 are formed with an passing hole 246 for insertion of the first inserting portion 221. On an end of the first inserting portion 221 that extends out of the passing hole 246 are sleeved an elastic member 222 and a C-shaped retainer 223, so as to provide an elastic force between the first inserting portion 221 and the oscillating element 24.

At another end of the oscillating element 24 is formed a horizontal oscillating portion 242 which is formed with a central hole 243 for insertion of a first bolt 244, so as to pivotally connect the oscillating element 24 to the linking rod 25.

The linking rod 25 is an elongated block with two circular ends. Each end of the linking rod 25 is formed with a bolt hole 250 for insertion of the first bolt 244 and a second bolt 251, respectively, and the second bolt 251 has one end inserted in the wiper arm 19 so as to drive the wiper arm 19.

At a middle portion of the wiper arm 19 is defined a pivot hole 191 for insertion the one end of the second bolt 251, and a bolt is laterally screwed in the pivot hole 191 to fix the second bolt 251, one end of the wiper arm 19 is formed with a second pivot portion 190 which is to be pivotally connected a corresponding part of the cantilever 12, and another end of the wiper arm 19 is assembled to the upper thread wiper 18. The drive device 20 of this embodiment is also capable of transmitting power as the drive device 20 of the first embodiment. The drive member 21 has two ears 212 at two ends thereof, a pin 214 is inserted through the two ears 212. The end of the motion-transmission rod 22 inserted between the ears 212 is a formed with a first pivot portion 220 for insertion of the pin 214, there is a clearance between the first pivot portion 220 and the two ears 212, and another end of the oscillating member 17 is drivingly connected to the needle shaft 15 by a connecting shaft 172.

Between the upper thread wiper 18 and the wiper arm 19 can also be disposed a quick release device 30 and corresponding structures for enabling the upper thread wiper 18 to be quickly assembled onto or removed from the wiper arm 19, as shown in FIGS. 3, 8-10, the quick release device 30, wherein the free end of the wiper arm 19 is formed with a laminar engaging end 193 which is formed with a first stop portion 194 in the form of a cavity opens upward. Adjacent to the first stop portion 194 is disposed a laminar elastic piece 195 which is bent upward to provide an upward elastic force.

The upper thread wiper 18 has a hooking end for cooperating with the needle shaft 15 to hook thread, another end of the upper thread wiper 18 is a horizontal connecting end 180 which is formed with two threaded connecting holes 182, and at both sides of the connecting end 180 is formed a protruding third stop portion 181.

The quick release device 30 includes a positioning sleeve 31 and a key 32. The positioning sleeve 31 is rectangular in cross section and formed with an second inserting portion 310 which has a width approximately equal to that of the connecting end 180 so as to accommodate the connecting end 180. At an opening end of the second inserting portion 310 are formed two concave engaging portions 311 for engaging with the stop portions 181. Two bolts 33 are inserted through a bottom surface of the positioning sleeve 31 and screwed into the connecting holes 182 of the connecting end 180, and the engaging end 193 of the wiper arm 19 is inserted in the second inserting portion 310.

Figure 9:
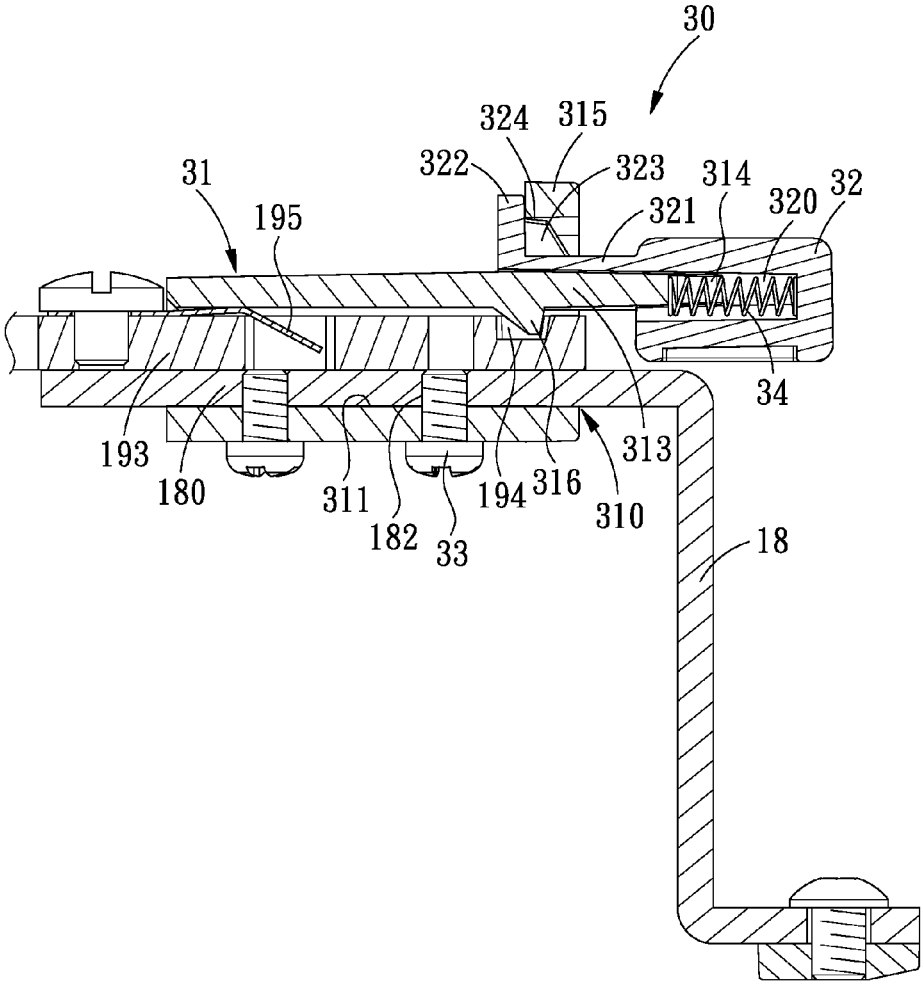
FIG. 9 is a cross sectional view of the drive device in accordance with the present invention.

At a top surface of the positioning sleeve 31 are formed two parallel slots 312 so as to create an elastic portion 313 which is integral with the positioning sleeve 31 at a position close to the engaging end 193 of the wiper arm 19 and has a free end extending toward the upper thread wiper 18. The free end of the elastic portion 313 extends out of the second inserting portion 310 and is formed with a positioning groove 314 for holding one end of a spiral spring 34, and another end of the spiral spring 34 is pushed against the key 32. At the opening end of the second inserting portion 310 of the positioning sleeve 31 is formed a U-shaped second stop portion 315 which is located above the free end of the elastic portion 313 to restrict the key 32. The elastic portion 313 is provided at a bottom surface thereof with a triangle protruding engaging portion 316 to be elastically engaged with the first stop portion 194 of the wiper arm 19, as shown in FIG. 9.

The key 32 is a rectangular block which is formed with a first chamber 320 which opens toward the positioning sleeve 31 for accommodation of the spiral spring 34 and the free end of the elastic portion 313. The spiral spring 34 pushes against the bottom of the first chamber 320 to provide an elastic force for separating the key 32 and the positioning sleeve 31 from each other. At an upper edge of an opening end of the first chamber 320 is formed an extending portion 321 which extends toward the second stop portion 315, and at a distal end of the extending portion 321 is formed a stop flange 322 perpendicular to the extending portion 321. At the corner defined between the extending portion 321 and the stop flange 322 are formed two slanting guide portions 323 which are lower than the stop flange 322, and at a top surface of each of the guide portions 323 is formed a horizontal stop surface 324.

Figure 10:
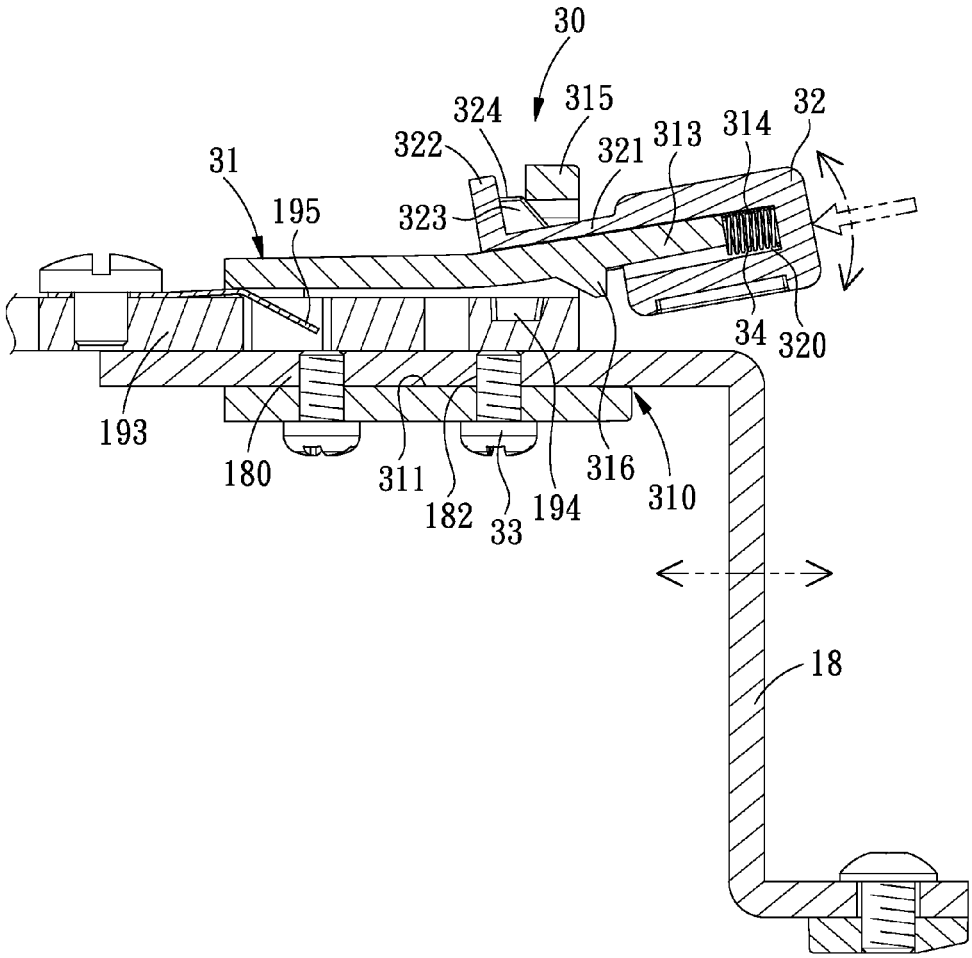
FIG. 10 is an operational cross sectional view of the drive device in accordance with the present invention.
Figure 11:
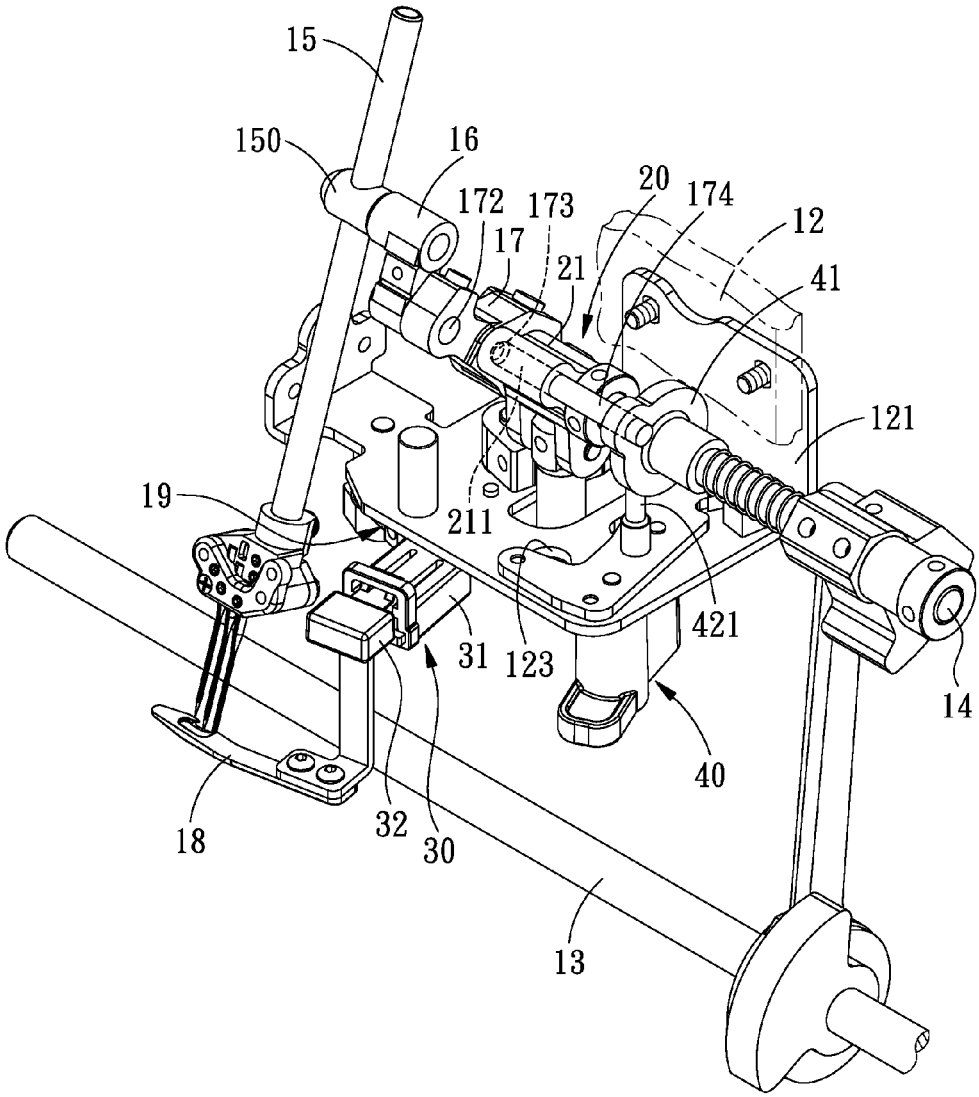
FIG. 11 is an operational view of the assembly the drive device, the quick release device and the clutch device shown in FIG. 2.

The key 32 is sleeved on the free end of the elastic portion 313 in such a manner that the stop flange 322 is inserted into the positioning sleeve 31 and stopped against the second stop portion 315. When the key 32 is pressed to compress the spiral spring 34, the extending portion 321 of the key 32 is located under the second stop portion 315, the free end of the elastic portion 313 is elastically deformable upward and downward. At this moment, as shown in FIG. 10, the engaging portion of the elastic portion 313 can be disengaged from the first stop portion 194 by pulling the upper thread wiper 18 from the wiper arm 19, and thus the upper thread wiper 18 can be removed from wiper arm 19. Similarly, to assemble the upper thread wiper 18 to the wiper arm 19, the key 32 is firstly pressed to make the engaging portion 316 elastically engaged in the first stop portion 194, when the key 32 is released, it will be pushed back by the spiral spring 34 to the position where the stop flange 322 is stopped against the second stop portion 315 again, and the key 32 and the free end of the elastic portion 313 will be pressed toward the first stop portion 194 of the wiper arm 19, so that the engaging portion 316 is engaged in the first stop portion 194 to prevent the upper thread wiper 18 from disengaging from the wiper arm 19, as shown in FIG. 9.

Figure 2:
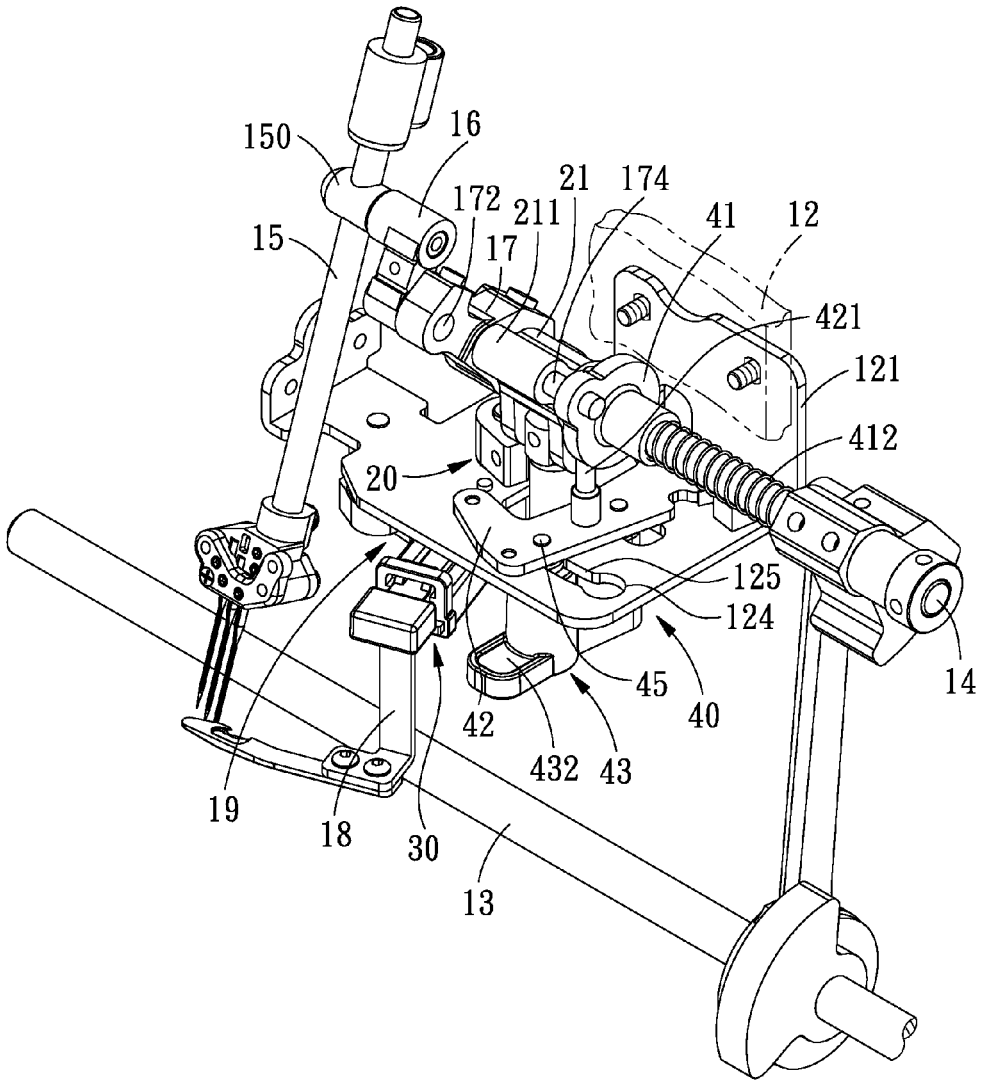
FIG. 2 is an assembly view of a drive device, a quick release device and a clutch device in accordance with the present invention.

Moreover, the drive device 20 is further provided with a clutch device 40 for driving the needle shaft 15, as shown in FIGS. 1-3, the oscillating member 17 is provided with a clutch hole 173 for the clutch rod 174 to insert in and out. The clutch rod 174 is pivotally inserted in the driven portion 211 of the drive member 21, and the end of the clutch rod 174 that extends out of the driven portion 211 is driven by the clutch device 40, so as to control the clutch rod 174 to insert in or disengage from the clutch hole 173 of the oscillating member 17.

The clutch device 40 includes a clutch member 41, a switch member 42 for controlling the position of the clutch member 41, a press member 43, a flexible member 44 in the form of a spiral spring, and a support pivot 45 fixed to the switch member 42. At the bottom of the cantilever 12 is provided a base frame 121 for mounting the aforementioned structures. The base frame 121 is bent to form an L-shaped structure and has a vertical end fixed to a rear surface of the cantilever 12 by two bolts. A horizontal end of the base frame 121 is formed with a limiting hole 122 located adjacent to the vertical end, and is further formed with two symmetrical first positioning portions 123 and 124 and a connecting portion 125 connected between the two first positioning portions 123, 124 in such a manner that the two first positioning portions 123, 124 are two holes located on the same circle whose center is the limiting hole 122, and a width of the connecting portion 125 is smaller than a diameter of the two first positioning portions 123.

The clutch member 41 of the clutch device 40 is a disc-shaped structure and formed with a driving-shaft hole 410 for insertion of the needle-shaft driving shaft 14, so that the clutch member 41 is slidably mounted on the needle-shaft driving shaft 14. Around a periphery of the clutch member 41 is formed a positioning hole 411 for insertion of the clutch rod 174 when the clutch rod 174 is in parallel to the needle-shaft driving shaft 14. A push member 412 in the form of a spiral spring is sleeved on the needle-shaft driving shaft 14 and biased between the driving-shaft hole 410 of the clutch member 41 and the needle-shaft driving shaft 14 to provide an elastic force for the clutch member 41 to push the clutch rod 174 toward the drive member 21.

The switch member 42 is a polygonal plate abutted against a top surface of the horizontal end of the base frame 121, and at one end of the switch member 42 is formed a third pivot portion 420 in the form of a hole. A pivot 46 is inserted through the limiting hole 122 and the third pivot portion 420 and retained by a C-shaped retainer. At the middle portion of a top surface of the switch member 42 is formed a cylindrical push portion 421 which extends to an end of the clutch member 41 that is not pushed by the push member 412, so that the clutch member 41 can be pushed by the push member 412 to rest against the push portion 421, and thus the clutch member 41 can be driven to move by the push portion 421. When the switch member 42 moves, the push portion 421 will push the clutch member 41 to make the clutch rod 174 engage in or disengage from the oscillating member 17.

The press member 43 is disposed below the horizontal end of the base frame 121 and aligned with the first positioning portions 123, 124 and the connecting portion 125. The press member 43 is formed with a second chamber 430 open downward for accommodation of the flexible member 44. The support pivot 45 is inserted through the flexible member 44 and the second chamber 430 and fixed by a bolt 450, so that the flexible member 44 is pushed by the bolt 450 toward the bottom of the second chamber 430, so as to provide a force for pushing the press member 43 toward the bottom surface of the horizontal end of the base frame 121. At a top surface of the press member 43 is formed a protruding second positioning portion 431 to be selectively engaged with the first positioning portions 123 and 124. At a bottom surface of the press member 43 is formed a press portion 432 which horizontally extends out of the press member 43, so that the user can press the press portion 432 and push it to move along the connecting portion 125 to control the positions of the switch member 42 and the clutch member 41, so as to effect or interrupt power transmission.

When the second positioning portion 431 of the press member 43 is engaged in the positioning portion 123 of the drive member 21, the switch member 42 which is driven by the press member 43 via the support pivot 45 will rotate around the pivot 46 to rotate to the push portion 421 and toward the drive member 21. The clutch member 41 will drive the clutch rod 174 to move toward the drive member 21, so that the clutch rod 174 can be inserted into the clutch hole 173 of the oscillating member 17 to effect power transmission. When the second positioning portion 431 of the press member 43 is engaged in the positioning portion 124 of the drive member 21, the switch member 42 is simultaneously driven to rotate to the push portion 421 to push the clutch member 41 to move away from the drive member 21, the clutch rod 174 will be disengaged from the clutch hole 173 of the oscillating member 17 to interrupt power transmission, namely, the power from the needle shaft 15 will be blocked from being transmitted to the upper thread wiper 18.

The rotary shaft 234 of the mounting frame 26 and the fixing pivot 260 can be pivoted or fixed to the bottom surface of the horizontal end of the base frame 121.

What mentioned above are the structural relations of the main components of the present invention, for a better understanding of the function and operation of the present invention, please refer to the following descriptions.

Firstly, the power of the drive device 20 for driving the upper thread wiper 18 directly comes from the needle-shaft driving shaft 14 that drives the needle shaft 15 instead of coming from the base 11 of the sewing machine, so that the structure of the sewing machine base is simplified. The drive device 20 is directly mounted on the cantilever 12, so that it can move synchronously with the needle shaft 15, reducing action error and power loss.

Secondly, the drive device 20 is located on the cantilever 12 which is within the user's vision, instead of on the base 11 or at the bottom of the sewing machine 10 which is beyond the user's vision, making the maintenance, operation and assembly of the drive device 20 much easier.

Thirdly, the quick release device 30 enables the upper thread wiper 18 to be quickly assembled onto or removed from the wiper arm 19.

Fourthly, the user can press the clutch device 40 to effect or interrupt power transmission while doing sewing, making the power transmission control easier. Furthermore, the press member 43 uses the second positioning portion 431 to selectively engage with the two symmetrical first positioning portions 123 and 124, improving the positioning effect of the clutch.

While we have shown and described various embodiments in accordance with the present invention, it is clear to those skilled in the art that further embodiments may be made without departing from the scope of the present invention.

What is claimed is:

1. A drive structure for driving an upper thread wiper of a sewing machine, the sewing machine comprising a base and a cantilever extending from the base, on the cantilever being disposed a needle-shaft driving shaft for driving a needle shaft mounted on the cantilever to repeatedly move up and down;

the upper thread wiper of the sewing machine being disposed on a wiper arm;

a drive device being disposed between the needle-shaft driving shaft and the wiper arm;

the drive device being provided with a drive member and a motion-transmission rod for converting rotation of the needle-shaft driving shaft into swing motion of the wiper arm;

one end of the drive member being drivingly connected to and driven by the needle-shaft driving shaft;

another end of the driving member being pivoted to one end of the motion-transmission rod via a pin;

another end of the motion-transmission rod being formed with a cylindrical first inserting portion;

one end of the wiper arm being formed with a second pivot portion for insertion of a fixing pivot which is fixed to the cantilever, and the upper thread wiper being fixed at another end of the wiper arm, the wiper arm being formed with a pivot hole, and the first inserting portion serving to drive the wiper arm.

2. The drive structure for driving an upper thread wiper of a sewing machine as claimed in claim 1, wherein on an end of the first inserting portion that extends out of the pivot hole is sleeved an elastic member to provide an elastic force between the wiper arm and the motion-transmission rod.

3. The drive structure for driving an upper thread wiper of a sewing machine as claimed in claim 1, wherein the another end of the drive member is formed with two ears, and the pin is inserted through the two ears;

one end of the motion-transmission rod is inserted between the two ears and formed with a first pivot portion, the pin is inserted through the first pivot portion, and there is a clearance between the first pivot portion and the two ears, so that the first pivot portion is able to move along the pin between the two ears.

4. The drive structure for driving an upper thread wiper of a sewing machine as claimed in claim 1, wherein the drive member and the oscillating member are integral with each other.

5. The drive structure for driving an upper thread wiper of a sewing machine as claimed in claim 4, wherein one end of the oscillating member is formed an inserting hole for insertion of the needle-shaft driving shaft, another end of the oscillating member is drivingly connected to the needle shaft, the oscillating member is formed with a clutch hole for insertion of a clutch rod;

the drive device is provided with the drive member, the motion-transmission rod, a rod-inserting member, an oscillating element and a linking rod which are interconnected to one another and serve to transmit power to the wiper arm, the drive member is formed with a through hole for insertion of the needle-shaft driving shaft, one end of the drive member is formed with a driven portion for insertion of the clutch rod, and another end of the drive member is formed with at least one ear for insertion of a pin;

one end of the motion-transmission rod is inserted to the ear and formed with a first pivot portion, the pin is inserted through the first pivot portion, there is a clearance between the first pivot portion and the ear, another end of the motion-transmission rod is formed with a cylindrical first inserting portion;

the rod-inserting member includes an inserting rod at one end thereof for insertion of the first inserting portion;

another end rod-inserting member is formed with a shaft-retaining portion for insertion of one end of a rotary shaft;

one end of the oscillating element is formed with a rotary-shaft hole for insertion of another end of the rotary shaft, and at another end of the oscillating element is formed an oscillating portion which is provided with a first bolt to pivotally connect the oscillating element to the linking rod;

the first bolt is inserted in one end of the linking rod, and a second bolt is inserted in another end of the linking rod, so as to drive the wiper arm;

one end of the wiper arm is formed with a second pivot portion, in the second pivot portion is inserted a fixing pivot which has one end fixed to the cantilever, and the wiper arm is further formed with a pivot hole for insertion of the second bolt.

6. The drive structure for driving an upper thread wiper of a sewing machine as claimed in claim 5, wherein on an end of the first inserting portion that extends out of the pivot hole are sleeved an elastic member and a retainer.

7. The drive structure for driving an upper thread wiper of a sewing machine as claimed in claim 5, wherein the fixing pivot is fixed to a mounting frame, and the rotary shaft is pivoted to the mounting frame.

8. The drive structure for driving an upper thread wiper of a sewing machine as claimed in claim 5, wherein shaft-retaining portion of the rod-inserting member is formed with a slit, and a bolt is screwed through the slit to retain the rotary shaft within the shaft-retaining portion in a clamping manner.

9. The drive structure for driving an upper thread wiper of a sewing machine as claimed in claim 5, wherein a quick release device is disposed between the upper thread wiper and the wiper arm;

a free end of the wiper arm is an engaging end which is formed with a first stop portion;

the upper thread wiper has a connecting end;

the quick release device includes a positioning sleeve and a key, the positioning sleeve is formed with an second inserting portion for accommodation of the connecting end and also for insertion of the engaging end of the wiper arm, the positioning sleeve includes an elastic portion which is provided with a spiral spring to push against the key, the positioning sleeve is formed with a second stop portion, the elastic portion is provided with an engaging portion to be elastically engaged with the first stop portion of the wiper arm, the key is formed with a first chamber for accommodation of the spring and the elastic portion so as to provide an elastic force for separating the key and the positioning sleeve from each other, the key is formed with an extending portion which extends toward the second stop portion, and at a distal end of the extending portion is formed a stop flange which is stopped and pressed against the second stop portion to make the engaging portion elastically engaged in the first stop portion, or pressing the key can make the engaging portion of the elastic portion disengage from the first stop portion, so that the upper thread wiper is removed from wiper arm.

10. The drive structure for driving an upper thread wiper of a sewing machine as claimed in claim 9, wherein a free end of the elastic portion is formed with a positioning groove for holding one end of the spiral spring, and another end of the spiral spring is pushed against the key.

11. The drive structure for driving an upper thread wiper of a sewing machine as claimed in claim 9, wherein a slanting guide portion is between the extending portion and the stop flange.

12. The drive structure for driving an upper thread wiper of a sewing machine as claimed in claim 9, wherein an elastic piece is located adjacent to the first stop portion is to provide an upward elastic force, at both sides of the connecting end is formed a protruding third stop portion, at an opening end of the second inserting portion are formed two engaging portions for engaging with the stop portions, two bolts are inserted through a bottom surface of the positioning sleeve and screwed into the connecting holes of the connecting end, and at a top surface of the positioning sleeve are formed two parallel slots so as to create the elastic portion.

13. The drive structure for driving an upper thread wiper of a sewing machine as claimed in claim 5, wherein the drive device is further provided with a clutch device for driving the needle shaft, the oscillating member is provided with a clutch hole for the clutch rod to engage in and disengage from the clutch hole, the clutch rod is pivotally inserted in the driven portion of the drive member, and one end of the clutch rod that extends out of the driven portion is driven by the clutch device, the clutch device includes a clutch member, a switch member, a press member, an flexible member, and a support pivot, the clutch member is slidably mounted on the needle-shaft driving shaft and fixed on the clutch rod, a push member is sleeved on the needle-shaft driving shaft to provide an elastic force to push the clutch member toward the drive member;

the switch member is formed with a third pivot portion for insertion of a pivot which is fixed on the cantilever, the switch member is formed with a push portion which extends toward the clutch member, so that the clutch member is pushed by the push member to rest against the push portion, when the switch member moves, the push portion will push the clutch member to make the clutch rod engage in or disengage from the oscillating member;

the support pivot is inserted through the press member and the flexible member and has one end fixed to the switch member and another screwed with a bolt, so that the flexible member is pushed by the bolt to provide a force for pushing the press member toward the cantilever, the press member is formed with a press portion for a user to press.

14. The drive structure for driving an upper thread wiper of a sewing machine as claimed in claim 13, wherein the cantilever is provided with a base frame for mounting of the clutch device;

the base frame is formed with a limiting hole and two symmetrical first positioning portions and a connecting portion connected between the two first positioning portions in such a manner that the two first positioning portions are located on the same circle whose center is the limiting hole;

the switch member is pivoted to the pivot that is fixed to the base frame;

the press member is formed with a second positioning portion and is able to slide along the connecting portion to enable the second positioning portion to be selectively engaged with the first positioning portions;

the press member is formed with a second chamber for accommodation of the flexible member, and the support pivot is inserted through the flexible member and the second chamber and fixed to the switch member.

15. The drive structure for driving an upper thread wiper of a sewing machine as claimed in claim 13, wherein the clutch member is formed with a driving-shaft hole for insertion of the needle-shaft driving shaft, and a positioning hole for insertion of the clutch rod when the clutch rod is in parallel to the needle-shaft driving shaft, a push member in the form of a spiral spring is sleeved on the needle-shaft driving shaft and biased between the driving-shaft hole of the clutch member and the needle-shaft driving shaft to provide an elastic force for the clutch member to push the clutch rod toward the drive member.

16. The drive structure for driving an upper thread wiper of a sewing machine as claimed in claim 1, wherein the drive device is provided with the drive member, the motion-transmission rod, a rod-inserting member, an oscillating element and a linking rod which are interconnected to one another to convert rotation of the needle-shaft driving shaft into swing motion of the wiper arm;

the needle-shaft driving shaft is inserted in and serves to drive the drive member;

the drive member is pivoted to the motion-transmission rod, the motion-transmission rod has an first inserting portion inserted through one end of the oscillating element whose middle portion is pivoted to the cantilever, another end of the oscillating element is pivoted to one end of the linking rod, and another end of the linking rod drives the wiper arm to swing.

17. The drive structure for driving an upper thread wiper of a sewing machine as claimed in claim 16, wherein the middle portion of the oscillating element is formed with a rotary-shaft hole for insertion of a connecting pivot fixed on the cantilever, one end of the oscillating element is formed with an passing hole for insertion of the first inserting portion, another end of the oscillating element is formed an oscillating portion which is formed with a central hole for insertion of a first bolt, so as to pivotally connect the oscillating element to the linking rod, each end of the linking rod is formed with a bolt hole for insertion of the first bolt and a second bolt, respectively, and the second bolt has one end inserted in the wiper arm so as to drive the wiper arm.

18. The drive structure for driving an upper thread wiper of a sewing machine as claimed in claim 17, wherein an elastic member is mounted on an end of the first inserting portion that extends out of the oscillating element to provide an elastic force between the first inserting portion and the oscillating element.

19. A drive structure for driving an upper thread wiper of a sewing machine, the sewing machine comprising a base and a cantilever extending from the base, on the cantilever being disposed a needle-shaft driving shaft for driving a needle shaft mounted on the cantilever and a wiper arm disposed at a bottom of the cantilever;

the upper thread wiper of the sewing machine being disposed on a wiper arm;

a quick release device is disposed between the upper thread wiper and the wiper arm;

a free end of the wiper arm is an engaging end which is formed with a first stop portion;

the upper thread wiper has a connecting end;

the quick release device includes a positioning sleeve and a key, the positioning sleeve is formed with an second inserting portion for accommodation of the connecting end and also for insertion of the engaging end of the wiper arm, the positioning sleeve includes an elastic portion which is provided with a spiral spring to push against the key, the positioning sleeve is formed with a second stop portion, the elastic portion is provided with an engaging portion to be elastically engaged with the first stop portion of the wiper arm, the key is formed with a first chamber for accommodation of the spring and the elastic portion so as to provide an elastic force for separating the key and the positioning sleeve from each other, the key is formed with an extending portion which extends toward the second stop portion, and at a distal end of the extending portion is formed a stop flange which is stopped and pressed against the second stop portion to make the engaging portion elastically engaged in the first stop portion.

20. The drive structure for driving an upper thread wiper of a sewing machine as claimed in claim 19, wherein an elastic piece is located adjacent to the first stop portion is to provide an upward elastic force, at both sides of the connecting end is formed a protruding third stop portion, at an opening end of the second inserting portion are formed two engaging portions for engaging with the stop portions, two bolts are inserted through a bottom surface of the positioning sleeve and screwed into the connecting holes of the connecting end, and at a top surface of the positioning sleeve are formed two parallel slots so as to create the elastic portion.

* * * * *